US008127382B1

(12) United States Patent
Plascencia et al.

(10) Patent No.: US 8,127,382 B1
(45) Date of Patent: Mar. 6, 2012

(54) PORTABLE COMPACT PILLOW SYSTEM

(75) Inventors: Jennifer Plascencia, Los Angeles, CA (US); Ian Gibbs, Washington, DC (US)

(73) Assignees: Jennifer Plascencia, Los Angeles, CA (US); Ian Gibbs, Washington, DC (US)

( * ) Notice: Subject to any disclaimer, the term of this patent is extended or adjusted under 35 U.S.C. 154(b) by 0 days.

(21) Appl. No.: 12/650,892

(22) Filed: Dec. 31, 2009

Related U.S. Application Data

(60) Provisional application No. 61/142,203, filed on Jan. 1, 2009.

(51) Int. Cl.
*A47G 9/10* (2006.01)

(52) U.S. Cl. ..... 5/639; 5/640; 5/645; 5/657; 5/490

(58) Field of Classification Search ..... 5/636, 639, 5/640, 645, 653, 657, 490, 491
See application file for complete search history.

(56) References Cited

U.S. PATENT DOCUMENTS

| | | | | |
|---|---|---|---|---|
| 3,863,283 | A * | 2/1975 | Mohr | 5/639 |
| 5,489,021 | A * | 2/1996 | Wallingford | 206/214 |
| 6,951,035 | B2 * | 10/2005 | Kinchen et al. | 5/420 |
| 7,322,057 | B2 * | 1/2008 | Merlini | 5/490 |
| 7,441,292 | B2 * | 10/2008 | Williams et al. | 5/636 |
| 2009/0293198 | A1 * | 12/2009 | Fodge et al. | 5/653 |

* cited by examiner

*Primary Examiner* — Michael Trettel

(57) ABSTRACT

A portable compact pillow system includes a travel carrier having a first half and a second half and also including a latching feature to secure the first half to the second half in a manner defining a hollow interior. A pillow is removably secured in a portion of the hollow interior defined by the first half, and a resilient member is secured in a portion of the hollow interior defined by the second half. The first half and the second half are attached one to the other on at least one side with a hinge such that the first half is separable from the second half and is pivotal about the hinge for substantially three-hundred-sixty degrees. The first half in its pivoted position is securable to the second half with the latching feature.

20 Claims, 13 Drawing Sheets

PORTABLE COMPACT PILLOW SYSTEM

RELATED U.S. APPLICATION DATA

This Non-Provisional patent application claims priority to Provisional Patent Application 61/142,203 filed Jan. 1, 2009 and is incorporated in its entirety herein by reference.

BACKGROUND OF THE INVENTION

1. Field of the Invention

The present invention relates to pillows in general and more particularly to a portable compact pillow system having storage compartments.

2. Discussion of the Related Art

A pillow is a large cushion support for the head, usually used while sleeping in a bed, or for the body as used on a couch or chair. Internally, a pillow comprises a filler made from foam, synthetic fills, feathers, or down to provide a resilient 'loft' to the pillow. The fill is surrounded with a cover or shell made of cloth, known as the pillow case or pillow slip. There are three main types of pillows; standard well-known rectangular bed pillows, orthopedic pillows having a shape and filler designed to relieve skeletal stress and decorative pillows, with some overlapping of use between these. A pillow is designed to provide support and comfort to the body, primarily support for the user's head and neck while sleeping.

Some pillows are specifically designated as travel pillows. These pillows are generally smaller in size than a normal pillow and can have different shapes also. One popular pillow is formed in a horseshoe shape to be placed around the user's neck and is particularly adapted for use in situations where the user is sitting upright or semi-reclined. While these pillows may be of a convenient size for traveling, they are typically sold as just the pillow with no accessories. The user must acquire a pillowcase to fit the pillow and then find a means to conveniently carry the pillow during their travels. If the user wishes to carry other items for use with the pillow, such as a blanket, etc. the user must also find a carrier in which both items fit and which is convenient to carry and Protect the items inside.

When traveling on common carriers, having the carrier supply pillows and blankets for sleeping is becoming less common. Thus, people must supply their own amenities to aid in sleep while traveling or do without. Therefore what is desired is a portable compact pillow system that is rugged and easy to transport, can carry items in addition to a pillow to help make the user comfortable when sleeping, and is protective of the system components.

When inverted 360 degrees, this novelty design provides a bed-like system where the pillow, backing and coils serve as a mattress, box and springs, respectively for increased compressive/supportive comfort vs. use of a standard pillow.

SUMMARY OF THE INVENTION

The present invention is directed to a portable compact pillow system that satisfies the need for a rugged and easily transportable pillow system. The portable compact pillow system includes a travel carrier having a first half and a second half and also including a latching feature to secure the first half to the second half in a manner defining a hollow interior. A pillow is removably secured in a portion of the hollow interior defined by the first half, and a resilient member is secured in a portion of the hollow interior defined by the second half. The first half and the second half are attached one to the other on at least one side with a hinge that the first half is separable from the second half and is pivotal about the hinge for substantially three-hundred-sixty degree rotation in reversed position. The first half is securable to the second half with the latching feature.

In a first aspect of the present invention, the latching feature is a zipper.

In another aspect, the latching feature is a dense hook and loop tape.

In yet another aspect, the present invention includes a resilient member provided about an interior periphery of the second half. The resilient member is sized and shaped to receive a folded blanket. The resilient member is of a sufficiently rigid material to support a person sitting upon the pillow when the blanket is removed therefrom. A panel can be provided at least partially covering the resilient member for aiding in maintaining the blanket in stored position.

In yet another aspect, the portable compact pillow system can further comprise a pair of back-pack straps.

In yet another aspect, the pillow can be removably secured via a dense hook and loop interface, a button and buttonhole interface, a hook and eye interface, an elastic and anchor interface, and the like.

In yet another aspect, a storage pouch can be provided upon an exterior of the pillow system, between the stored pillow and the first half, within a portion of the recess provided by the resilient member, upon a panel provided upon the resilient member, and the like.

These and other features, aspects, and advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the accompanying drawings in which.

Like reference numerals refer to like parts throughout the several views of the drawings.

DETAILED DESCRIPTION OF THE PREFERRED EMBODIMENT

Figure 2:
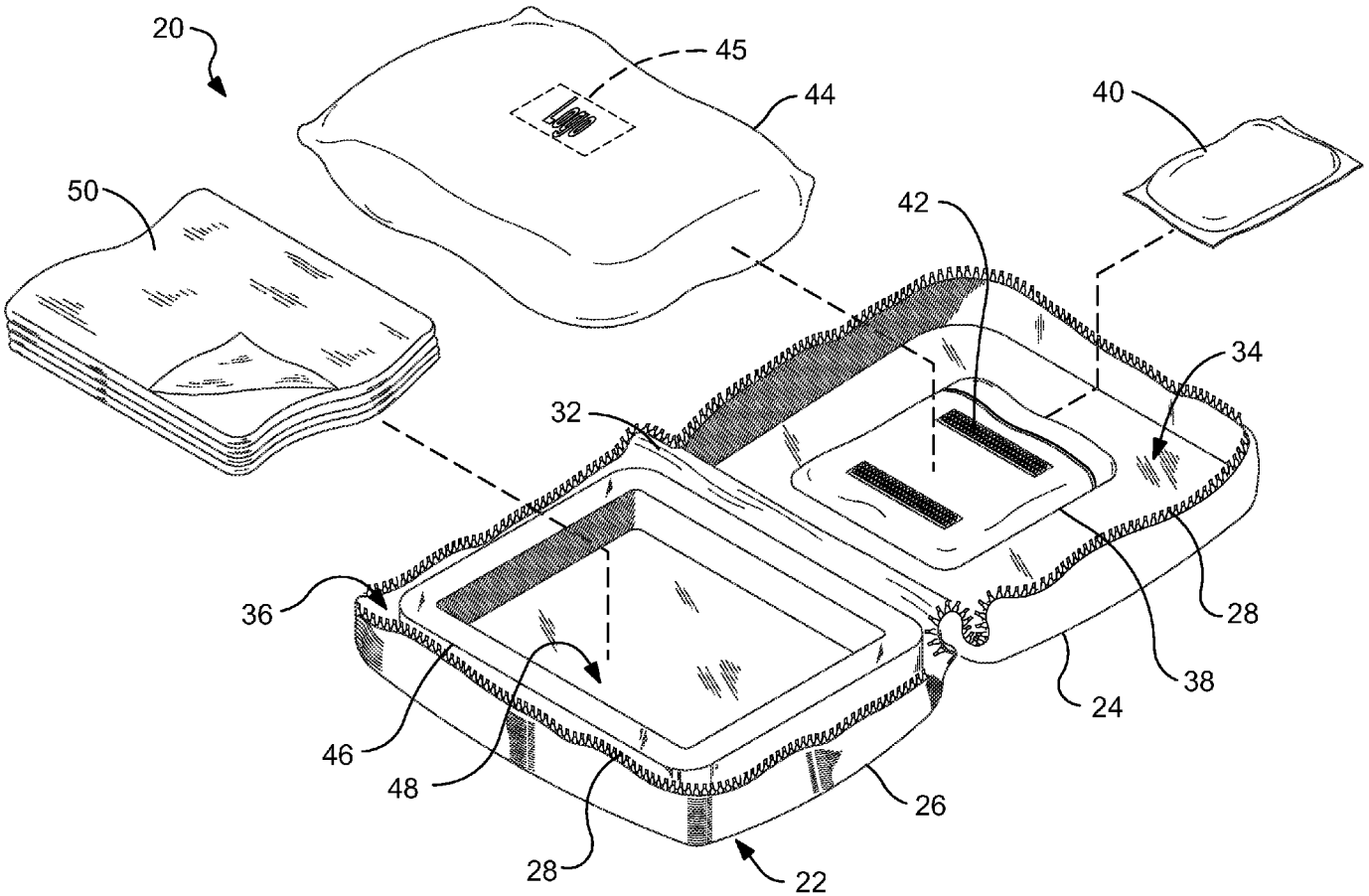
FIG. 2 is an exploded view of the pillow system in of FIG. 1.

For purposes of description herein, the terms "upper", "lower", "left", "rear", "right", "front", "vertical", "horizontal", and derivatives thereof shall relate to the invention as oriented in FIG. 2. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
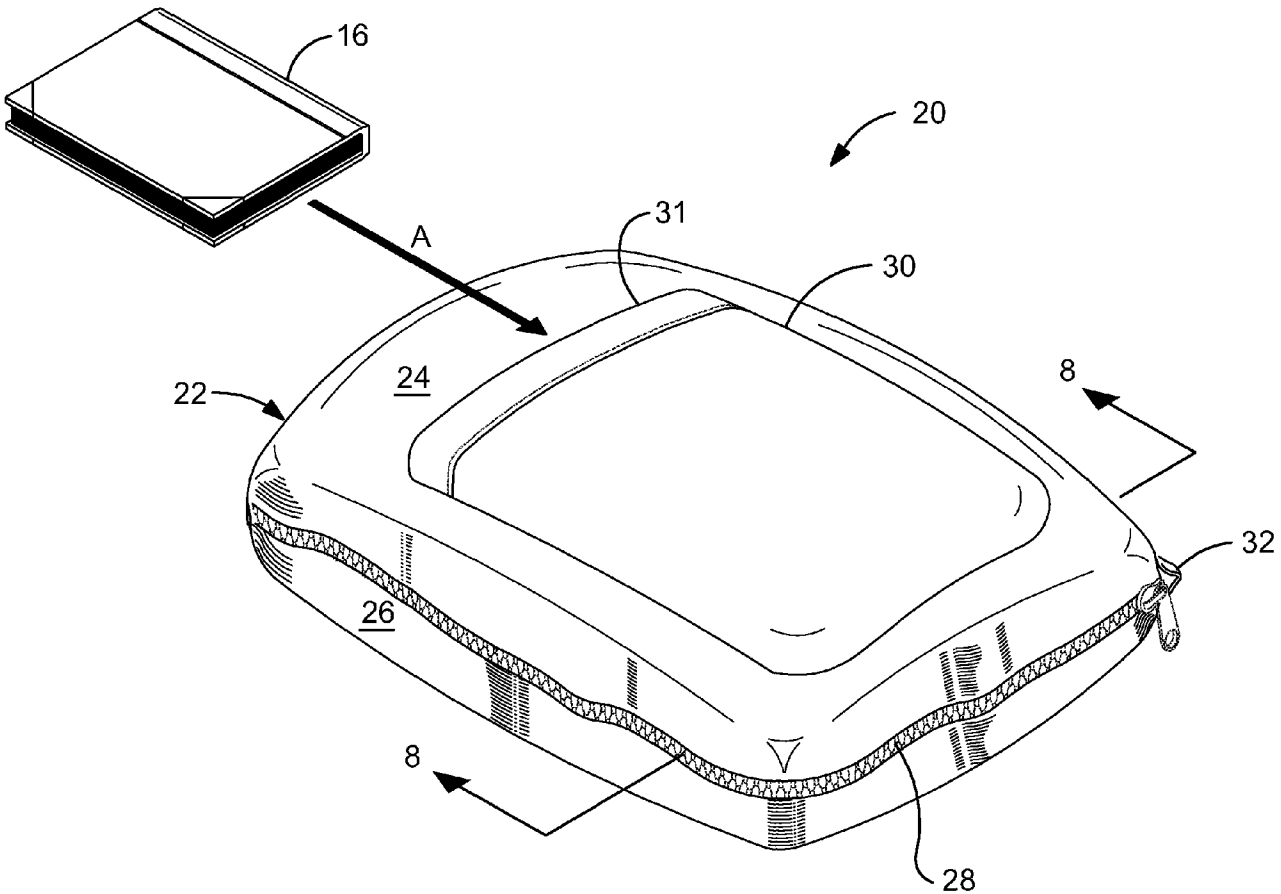
FIG. 1 is a perspective view of a pillow system embodying the present invention, wherein an exterior includes a pouch for securing a planning book.

Turning to the drawings, FIG. 1 shows a portable compact pillow system 20, which is one of the preferred embodiments of the present invention and illustrates its various components. Pillow system 20 generally comprises a travel carrier 22 having a first half 24 and a second half 26 which are interconnected with a latching system such as zipper 28. First half 24 and second half 26 are connected one to the other with hinge 32 for pivotal movement one with respect to the other. Travel carrier 22 can have an external pouch 30 fastened thereto for removably securing items such as a planner 16. Planner 16 can be inserted in pouch 30 by sliding planner 16 along arrow "A" into an open end 31 of external pouch 30 for convenient access to the user of pillow system 20.

Figure 3:
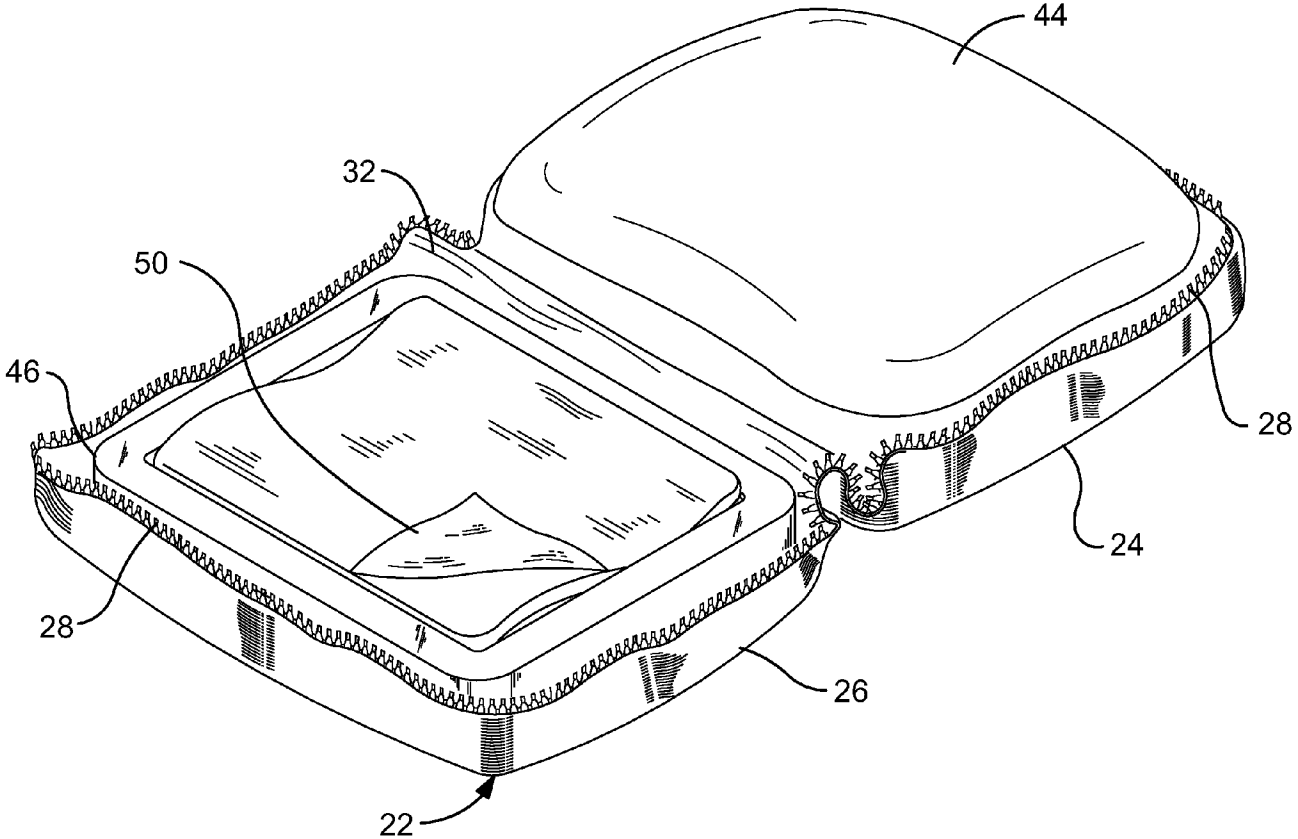
FIG. 3 is an assembled perspective view of the pillow system of FIG. 2.
Figure 8:
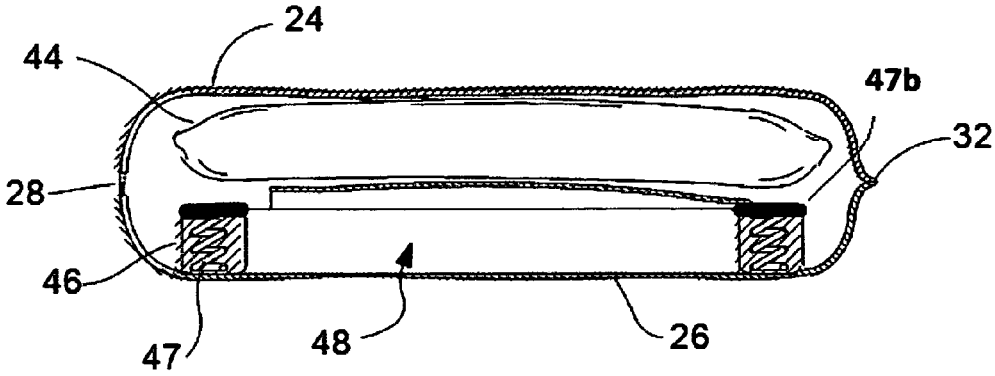
FIG. 8 is a cross-sectional view of the pillow system shown in FIG. 1 and taken along the line 8-8, FIG. 1.

Turning to FIGS. 2-3 and 8, pillow system 20 is shown in an opened configuration. Pillow system can be opened by releasing latching mechanism 28 and pivoting first half 24 and second half 26 apart one from the other about hinge 32. First half 24 defines an interior 34 which is sized to receive a pillow 44 therein. Interior 34 can be of a thickness such that pillow 44 is compressed to reduce its loft while stored to provide a more compact pillow system 20. Pillow 44 can include an emblem or logo 45 on a surface thereof such as for a college athletic team or a professional athletic team to customize pillow system 20 for sales to fans. Pillow 44 is further secured to first half 24 by a fastening system 42 such as a hook and loop fastener well known in the industry wherein one of the hook and loop elements (not shown) is attached to pillow 44 and a mating element (shown) is attached to the interior of first half 24. The pillow 44 can be fabricated having a casing of any soft material, such as cotton, velour, suede, silk, soft polyester, and the like, and any reasonable blend thereof. The pillow can be stuffed with any reasonably suited material, such as poly-fill, microbeads, down feathers, foam popcorn filling, a foam block, shredded foam, and the like, as well as any combination thereof. (While pillow 44 is described herein as being selectively removable, those practiced in the art will recognized that pillow 44 can be fixed within first half 24 and non-removable.) As illustrated, one portion of fastening element 42 is attached to an internal pocket 38. Internal pocket 38 can receive therein a cooling or warming pack 40. Pack 40 can be activated and placed in pocket 38 while pillow 44 is retained within travel carrier 22 and travel carrier 22 in an assembled form is used as a pillow. Pack 40, proximate to the outer surface of first half 24, provides a cooling or warming sensation to the user as the user rests his or her head on pillow system 20. The first half 24 of pillow system 20 can be fabricated of any soft material, such as cotton, spandex, velour, suede, silk, soft polyester, and the like, and any reasonable blend thereof. The first half 24 of pillow system 20 can be padded having a thin cavity filled with any reasonably suited material, such as poly-fill or other fibrous filler, microbeads, down feathers, foam popcorn filling, a foam block, shredded foam, and the like, as well as any combination thereof.

Second half 26 defines an interior portion 36 which receives a resilient member 46 therein. Resilient member 46 as illustrated in FIGS. 2-3 and 8 defines a recess 48, which, in turn, receives a blanket 50 therein (FIG. 3). Resilient member 46 can be constructed of open or closed cell resilient foam and can have springs 47 embedded therein for additional resilient support. Blanket 50 can be readily removed from travel carrier 22 when carrier 22 is in an open configuration, and resilient member 46 functions to provide support to travel carrier 22 when blanket 50 is removed therefrom. The second half 26 can include a pocket for storing items such as keys, an MP3 player, a video player, a cell phone, and the like. The second half 26 can be apportioned using a portion to store the blanket 50 and the balance to store other material such as additional resilient member 46.

The travel carrier 22 can be fabricated of a variety of materials, including woven fabric, man-made materials, leather, and the like. With considerations towards use in an outside environment, the travel carrier 22 can be fabricated of a weather resilient/waterproof material, seams, and releasing latching mechanism 28.

Figure 4:
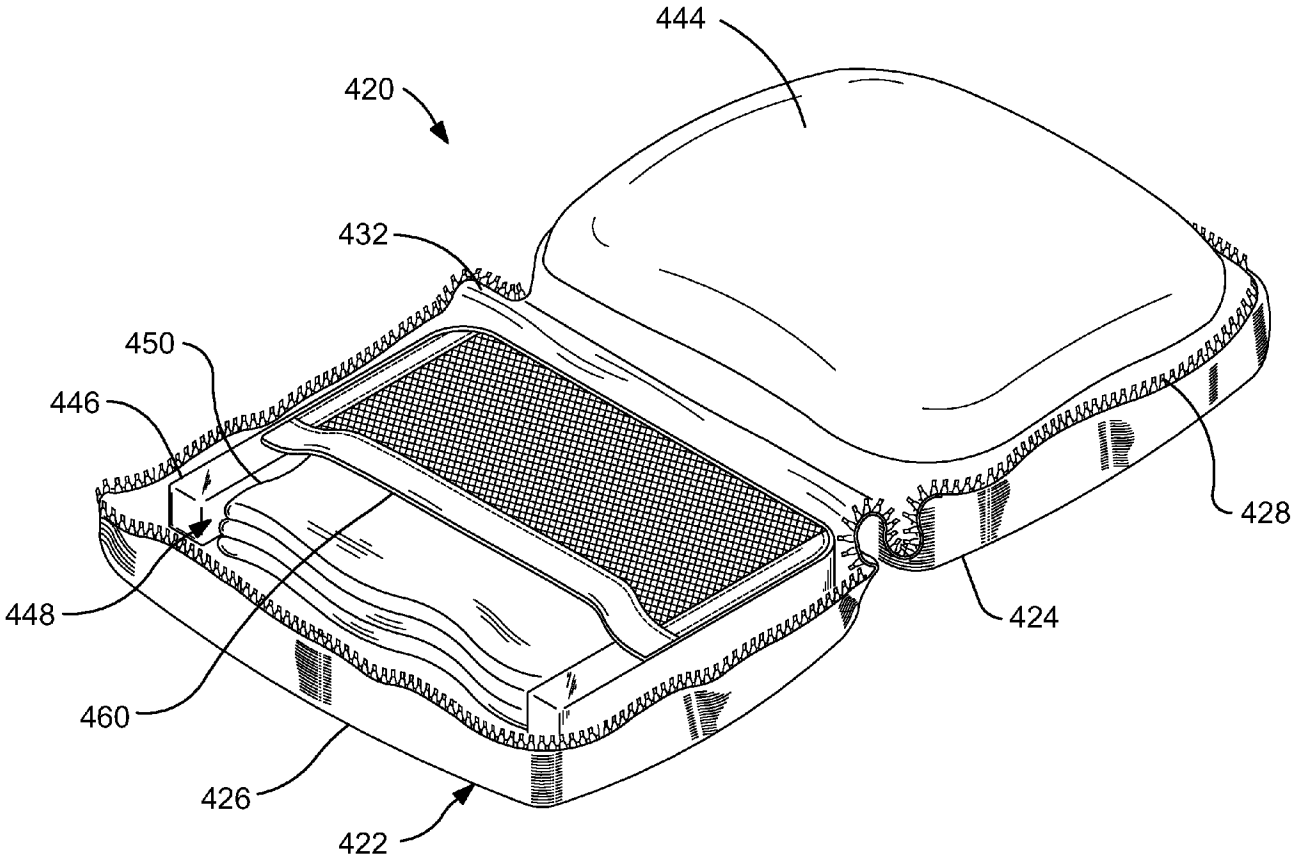
FIG. 4 is an alternate embodiment of the pillow system of FIG. 3 illustrating a mesh internal storage pocket.

Turning to FIG. 4, an alternate embodiment pillow system 420 is illustrated wherein first and second halves 424 and 426 of a travel carrier 422 are selectively secured one to another with fastening system (zipper) 428. First half 424 retains a pillow 444 therein and second half retains therein a blanket 450. Blanket 450 is secured on three sides by resilient member 446 and further secured by mesh panel 460 extending over a portion of recess 448 defined by resilient member 446. Resilient member 446 and mesh panel 460 in combination form a pocket for receiving blanket 450 therein.

Figure 5:
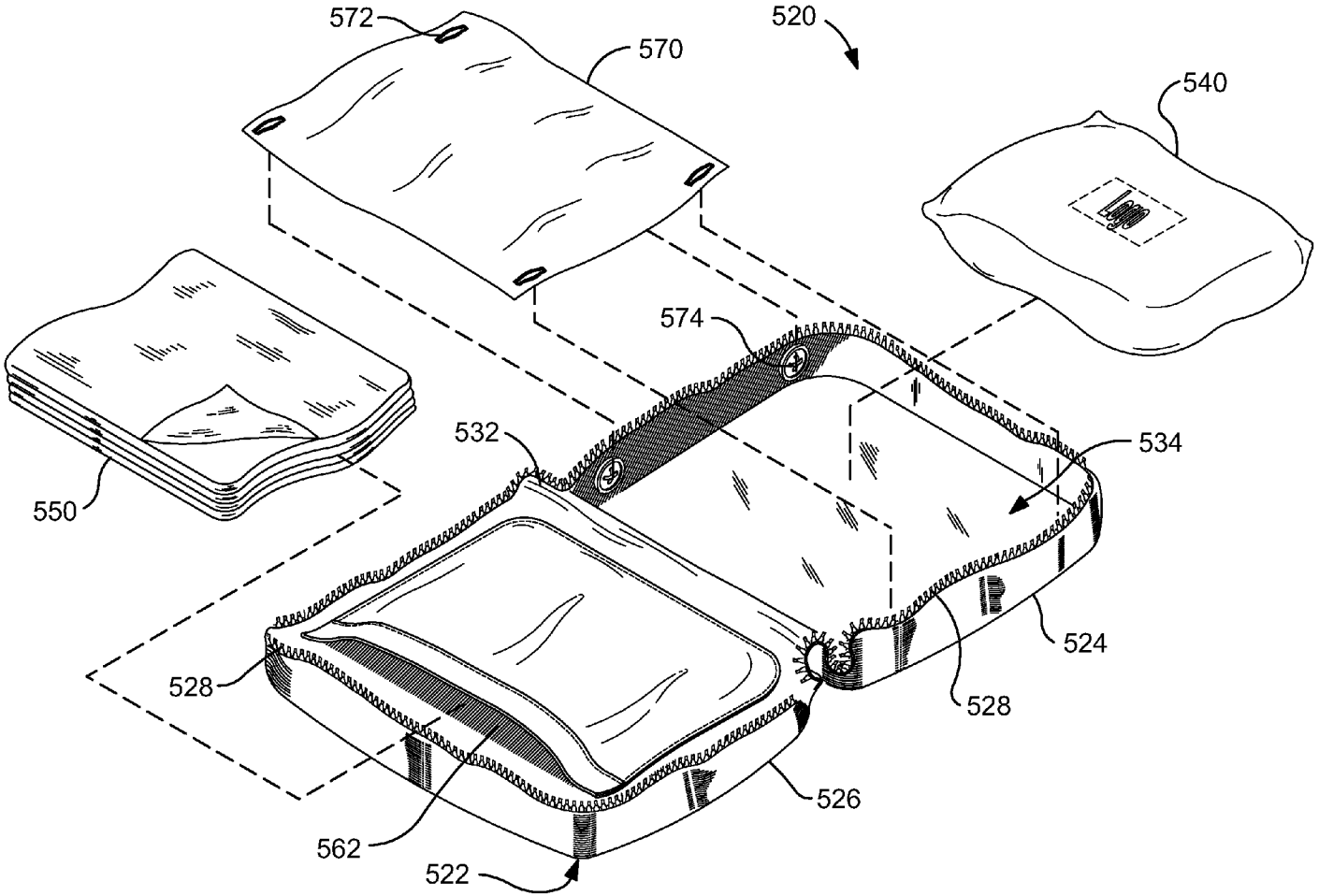
FIG. 5 is an exploded view of an alternate embodiment pillow system illustrating an alternate cover for retaining a removable pillow.

FIG. 5 illustrates yet another alternate pillow system embodiment 520. Travel carrier 522 incorporates a pocket retainer 562 for securing blanket 550 in second half 526. First half 524 includes buttons 574 affixed to interior 534 thereof. A pillow retainer 570 includes buttonholes 572 corresponding to locations of buttons 574 for securing pillow retainer 570 to interior 534. In use, the user places pillow 540 in interior 534 of first half 524. Pillow retainer 570 is placed over pillow 540 and buttons 574 are received through button holes 572 thereby securing pillow 540 and pillow retainer 570 in interior 534 of first half 524. First and second halves 524 and 526 can then be pivoted about hinge 532 and secured together with zipper 528. It is understood that any disengaging mechanical fastener can be utilized for the buttonholes 572 and corresponding buttons 574. Such disengaging mechanical fasteners can include snaps, hooks and loops, ribbons, frog closures, ribbon and eyelets, elastic and respective anchors, and the like.

Figure 6:
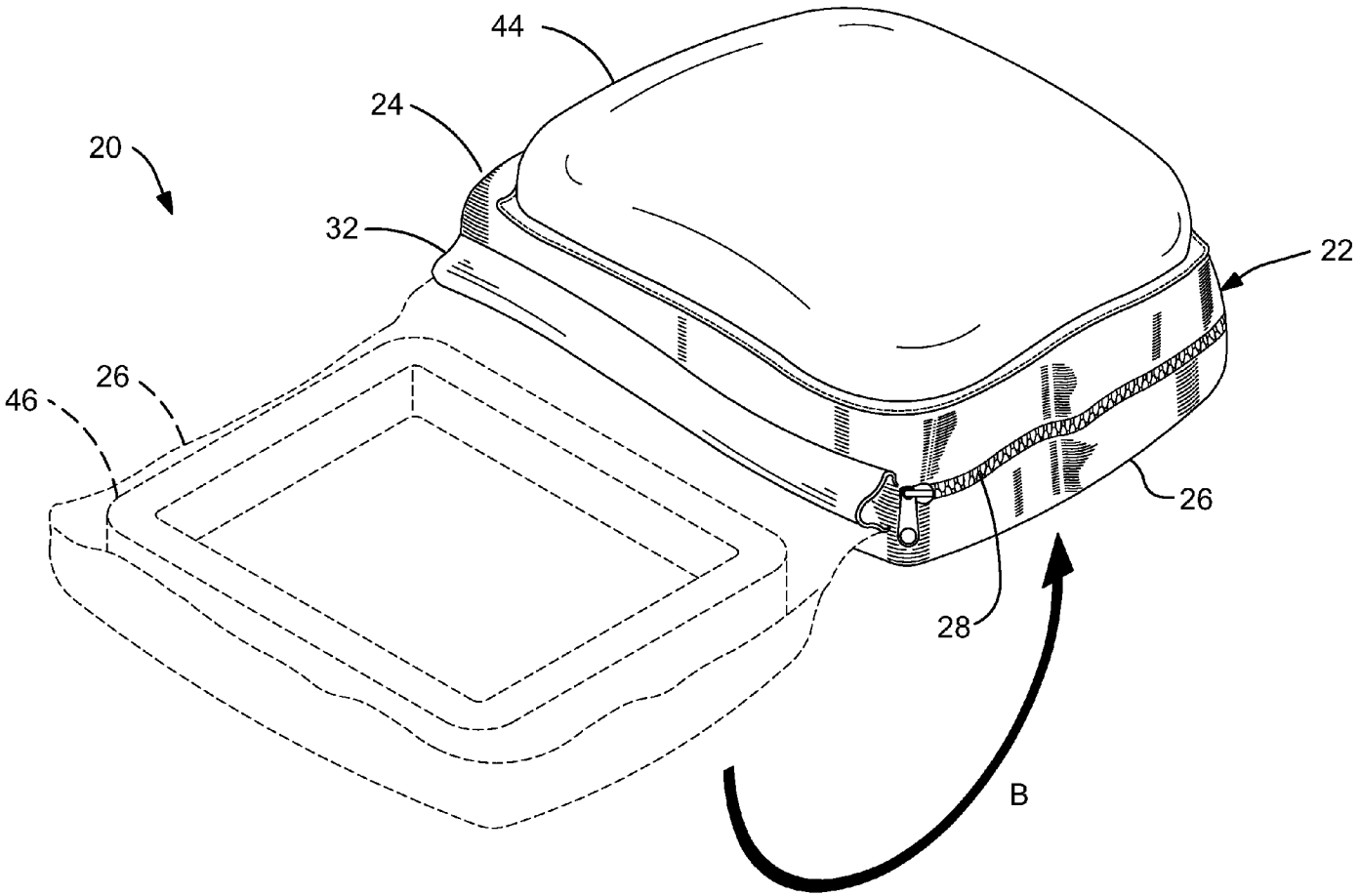
FIG. 6 is a perspective view of an alternate case embodiment showing the case zipped in a reversed configuration.

Referring now to FIGS. 1 and 6, pillow system 20 is illustrated (FIG. 6) wherein travel carrier 22 is secured in an alternate fastened position other than the closed position illustrated in FIG. 1. To obtain the alternate fastened position, travel carrier 22 is unzipped from its normal traveling configuration wherein second half 26 is above and in registration with first half 24 as illustrated in FIG. 1. Second half 26 is pivoted about hinge 32 in a manner to be in registration with and below first half 24 (Arrow "B"). Zipper 28 is then mated zipper half to mating zipper half and closed to again present a fastened travel carrier in an "inside-out" configuration. In this configuration, travel carrier 22 presents pillow 44 as externally exposed on the top of pillow system 20 and wherein pillow system 20 is supported from below by resilient member 46. Hinge 32 is a fabric member extending substantially along a length of travel carrier 22 and is of sufficient width to accommodate the reversed configuration of travel carrier 22.

Figure 7:
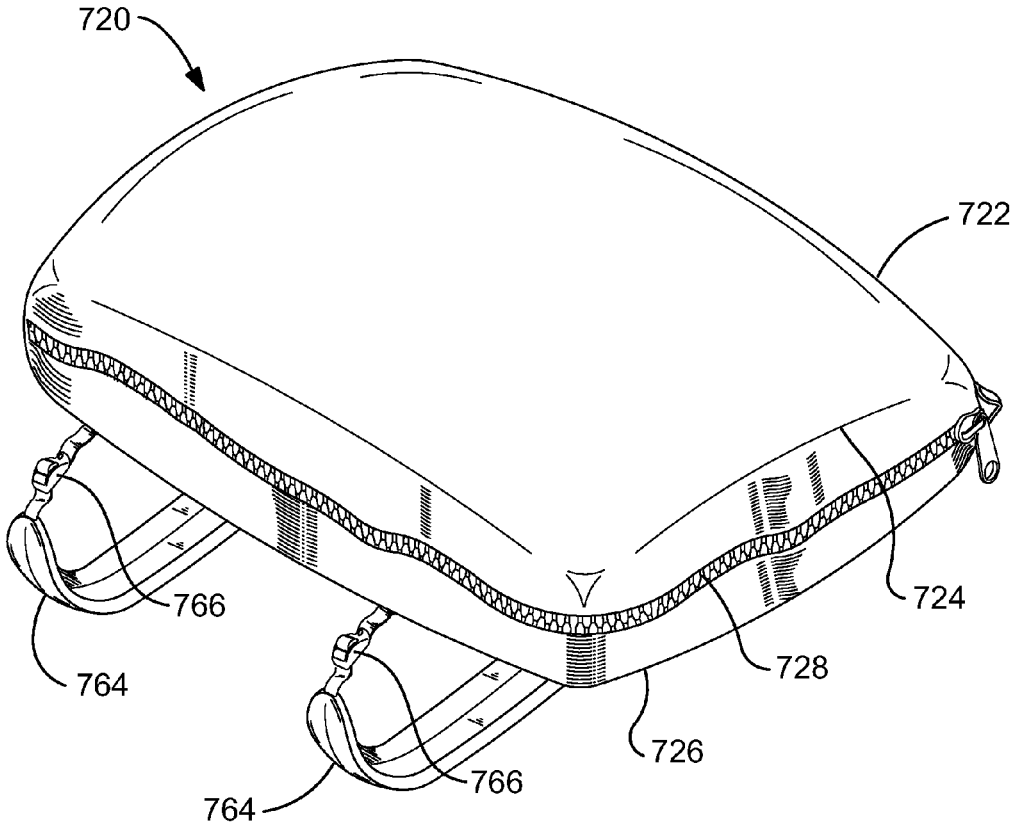
FIG. 7 is an alternate embodiment of the case of the pillow system including back pack straps.

FIG. 7 illustrates yet another pillow system embodiment 720 wherein travel carrier 722 includes a pair of back pack straps 764 fastened to an exterior of either first half 724 (not shown) or second half 726 (shown). Straps 764 facilitate easy carrying by the user and can also be used to secure pillow system 720 to a bench type seat when used as a seat cushion. Each of the pair of back-pack straps 764 can optionally comprise a length adjusting mechanism 766 to optimize the length of the strap 764 for the user's comfort.

Figure 9:
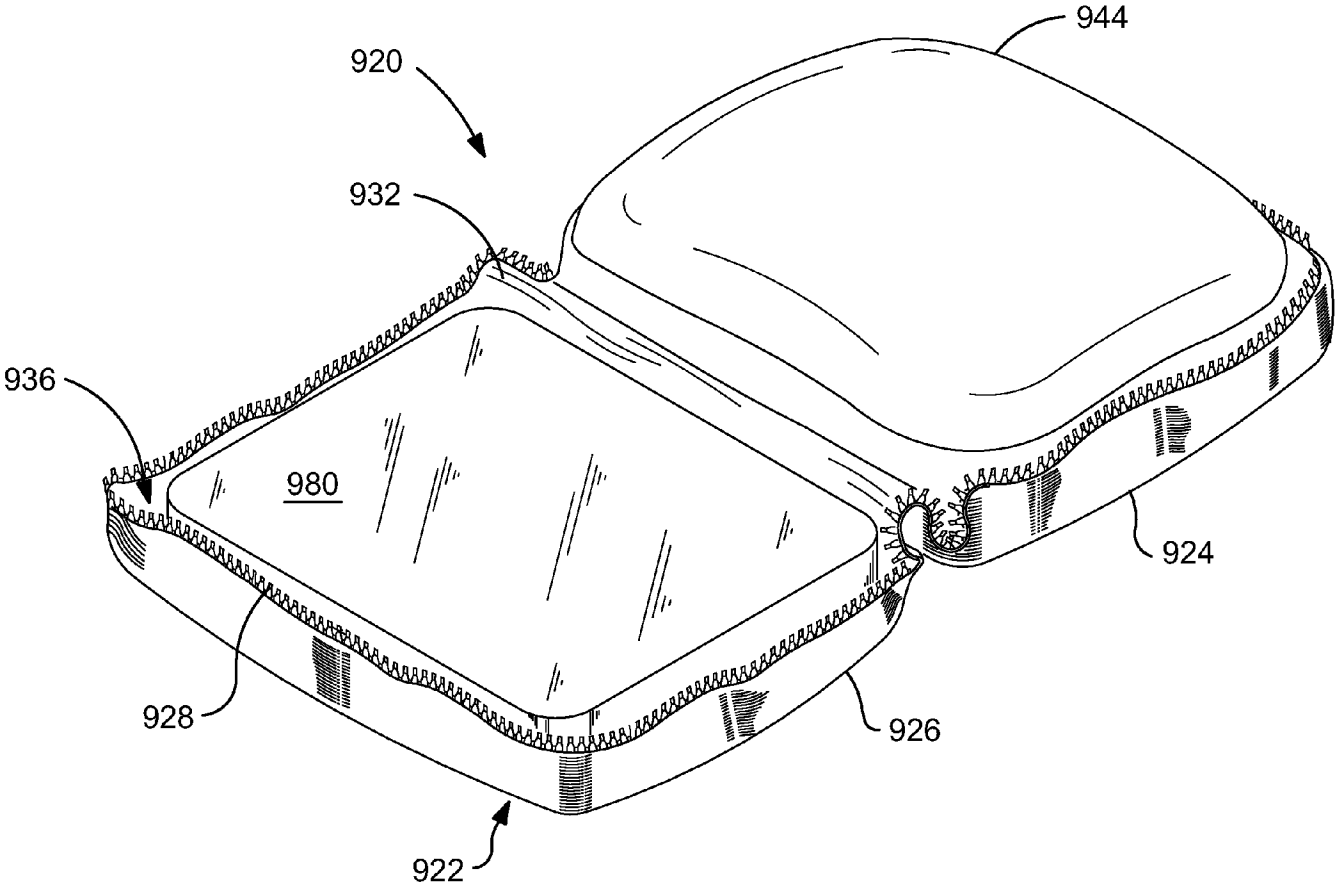
FIG. 9 is a perspective view of the interior of an alternate embodiment of the pillow system with no provisions for blanket storage.

FIG. 9 illustrates a pillow system embodiment 920 that does not include an internally retained blanket. Second half 926 defines an interior 936 that retains resilient member 980. Resilient member 980 is constructed of resilient open or closed cell foam and can include a plurality of internal springs embedded within the foam (as illustrated in FIG. 8). Resilient member 980 is of substantially constant thickness throughout and does not define a central recess into which a blanket can be received.

Figure 10:
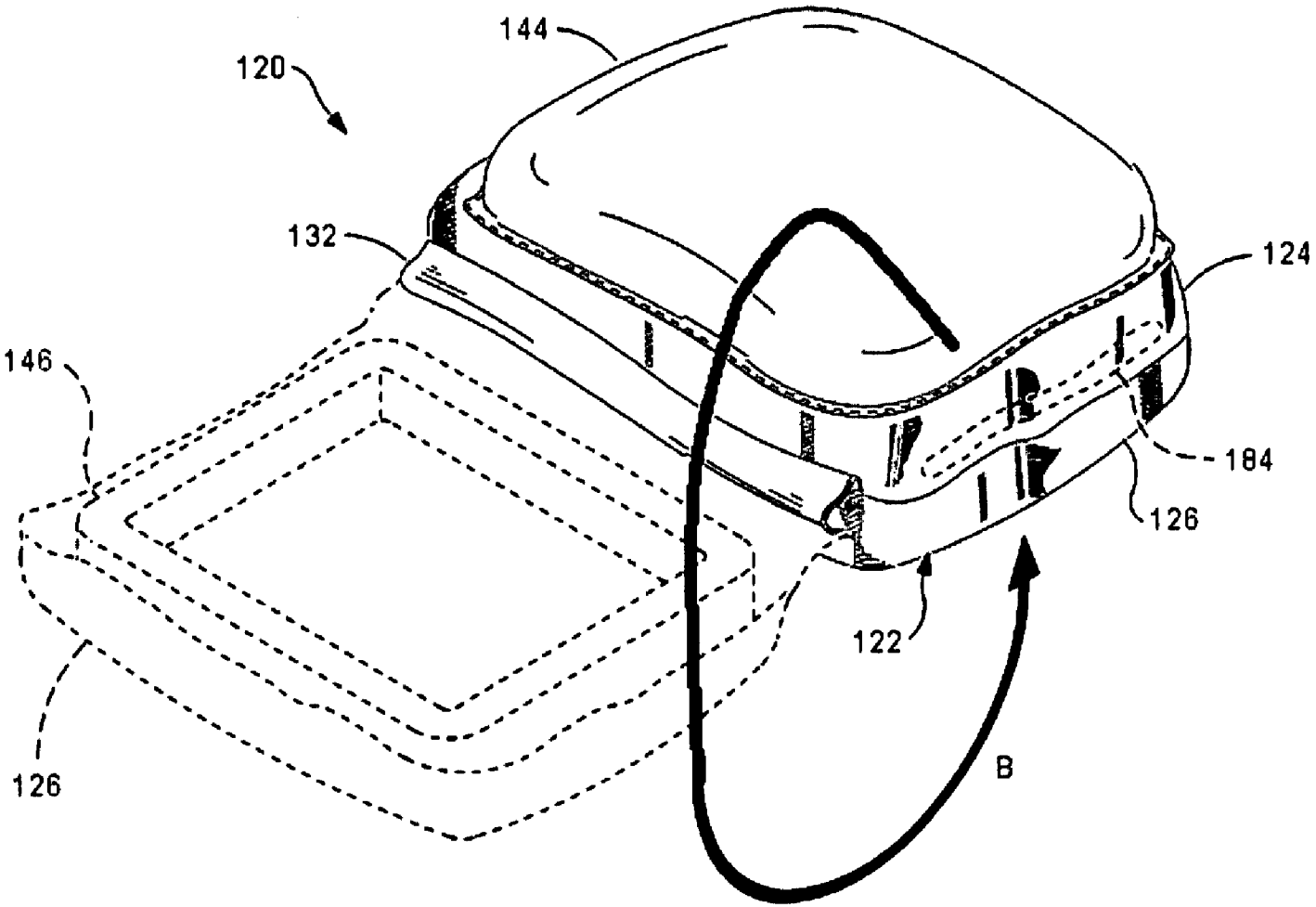
FIG. 10 is a perspective view of a reversible case for the pillow system with no zipper.
Figure 11:
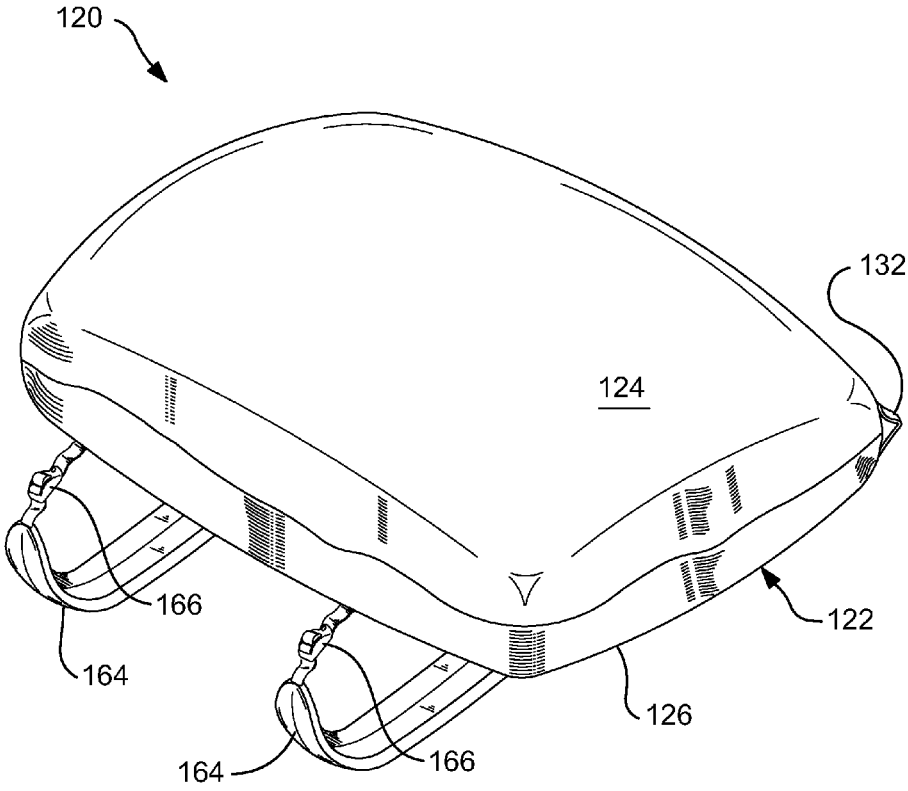
FIG. 11 is a perspective view of a case for the pillow system without a zipper and including back-pack straps.

FIGS. 10 and 11 illustrate an alternate pillow system embodiment 120 wherein the latching feature is other than a zipper and can be a hook and loop fastener 184 or other friction type fastening measure. Such fastening measures eliminate the uncomfortable sensation of a mechanical mechanism such as a zipper from chafing against the user's skin. Fastener 184 is arranged in a manner that second half 126 can be pivoted substantially three-hundred-sixty degrees about hinge 132 to secure travel carrier 122 in an "inside-out" configuration. Again, in its "inside-out" configuration, pillow system 120 has pillow 144 exposed externally and is support therebelow by resilient member 146. As further illustrated in FIG. 11, pillow system 120 can have a pair of back-pack straps 164 affixed to an exterior to facilitate convenient carrying of pillow system 120. Each of the pair of back-pack straps 164 can optionally comprise a length adjusting mechanism 166.

In use, a user of pillow system 20 or one of the alternate embodiments illustrated herein transports pillow system 20 to the place the user desires to utilize system 20. Pillow system can be used in multiple manners. Zipper 28 can be opened to allow extraction of pillow 44 and blanket 50 from travel carrier 22 for independent use. Travel carrier 22 can be reversed to be supported by resilient member 46 thereby allowing resting of the user's head against the comfortable cloth of pillow 44. Pillow system can also be used as a pillow or as a seat cushion wherein pillow 44 is retained within travel carrier 22 and is oppositely supported by resilient member 46 retained in second half 26. Resilient member 46 functions as a support whether blanket 50 remains secured in recess 48 or is removed for use to preserve bodily warmth. Thus, the user is provided a pillow system that is adaptable to multiple uses and is easily transported in a rugged carrier to prevent damage or soiling of the pillow and blanket retained internally.

Figure 12:
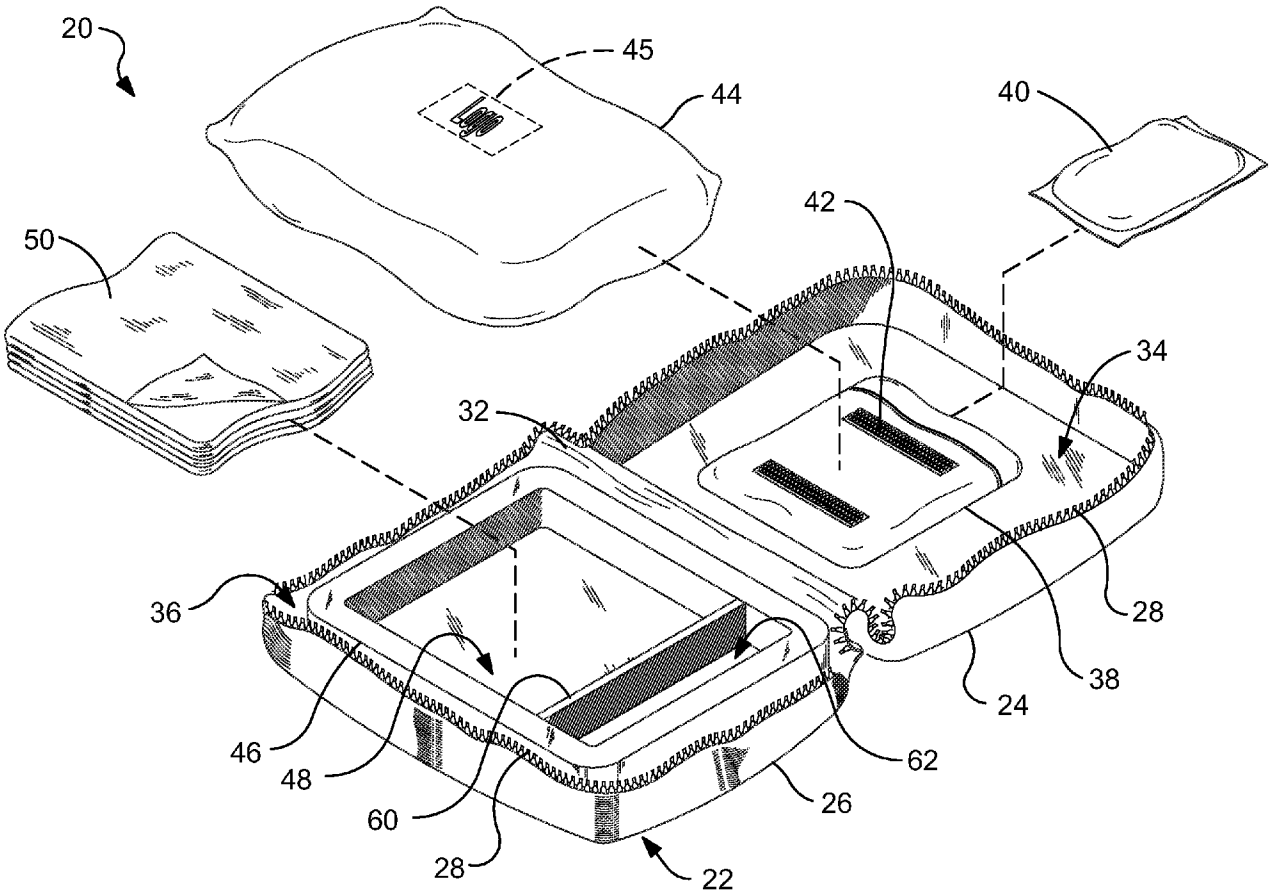
FIG. 12 is an exploded view of the pillow system of FIG. 1, further introducing an optional personal object storage cavity.
Figure 13:
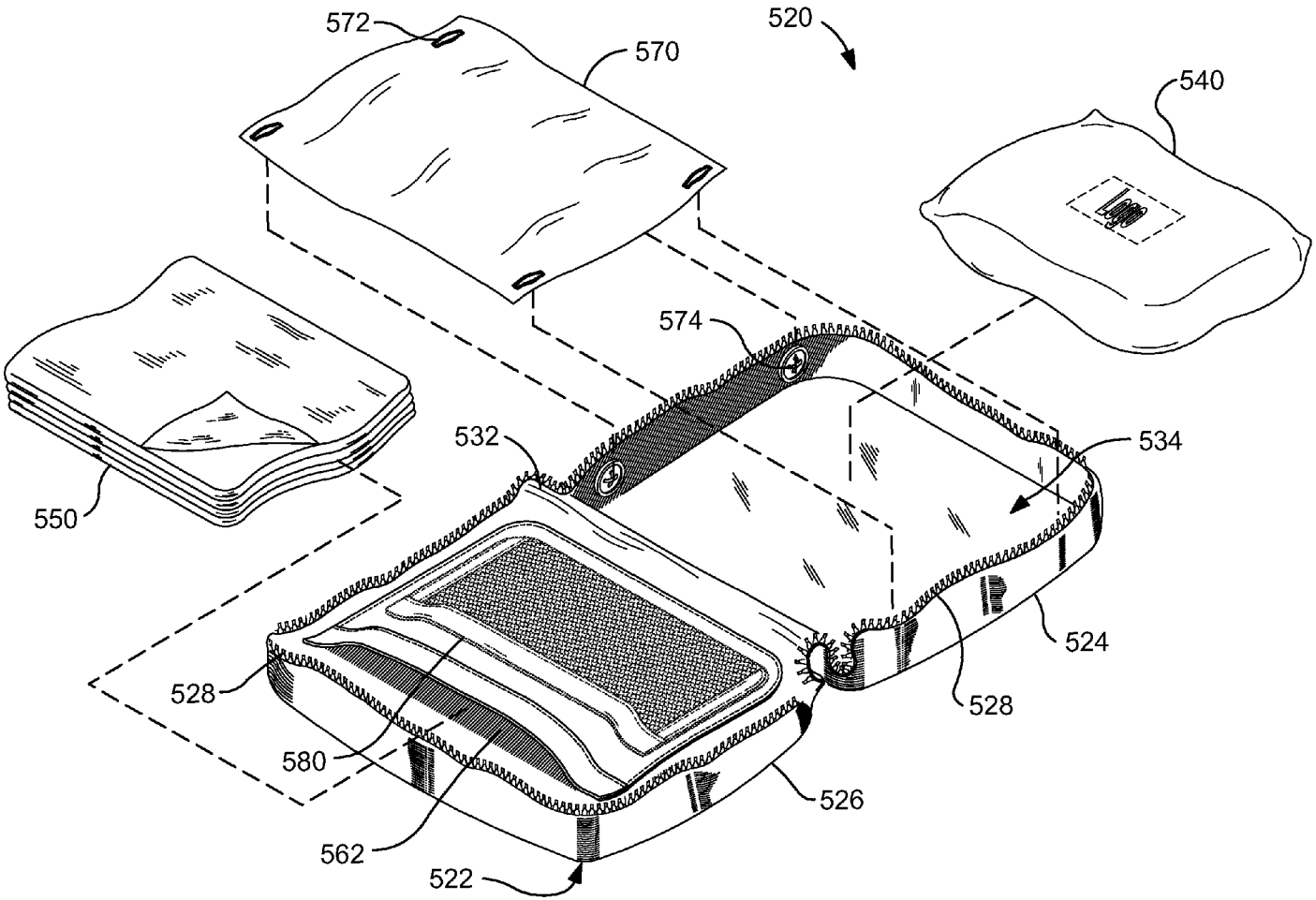
FIG. 13 is an exploded view of the alternate embodiment pillow system of FIG. 5, further introducing an optional personal object storage pocket.

FIGS. 12 and 13 illustrate optional object carrying pockets. The compact pillow system 20, originally presented in FIG. 2, is illustrated including an optional recess divider 60 provided within the interior of resilient member 46 in FIG. 12. The optional recess divider 60 defines recess 48 and an object storing section 62. The optional recess divider 60 is preferably of a semi-rigid or rigid material, such as foam. The optional recess divider 60 can be moveable or removably assembled to the resilient member 46. A dense hook and loop fastener, a series of snaps, a series of slots, and the like can be utilized for the optional recess divider 60 to resilient member 46 interface. The alternate pillow system embodiment 520, originally presented in FIG. 5, is illustrated in FIG. 13 illustrating an optional interior object pocket 580 disposed upon the pocket retainer 562. The optional interior object pocket 580 can be fabricated of a mesh, a soft material, a stretchy material (such as spandex), and the like. The optional interior object pocket 580 can additionally be padded such as with a foam or fibrous filler lining to protect sensitive objects such as phones, cameras, MP3 players, and the like.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

We claim:

1. A travel carrier having a first half and a second half, said first half and said second halves defining a hollow interior and are attached one to the other on at least one side with a hinge such that there is a pivot about said hinge for substantially three-hundred-sixty degrees, said first half in a pivoted reversed position securable to second half via a latching feature;

a pillow removably secured in a portion of said hollow interior by a disengaging mechanical fastener defined by said first half; and a resilient member secured in a portion of said hollow interior defined by said second half.

2. A portable compact pillow system as recited in claim 1 wherein said resilient member defines a central recess and further including a blanket removably secured within said recess.

3. A portable compact pillow system as recited in claim 2, said pillow system further comprising a pocket retainer at least partially covering said central recess, further securing said blanket therein.

4. A portable compact pillow system as recited in claim 1 wherein said latching feature is a zipper.

5. A portable compact pillow system as recited in claim 1 wherein said latching feature is a hook and loop fastener.

6. A portable compact pillow system as recited in claim 1 wherein said pillow is secured within said first half via a disengaging mechanical fastener.

7. A portable compact pillow system as recited in claim 6 wherein said disengaging mechanical fastener is selected from a group consisting of:

a. a hook and loop tape fastener,
b. buttons and respective buttonholes,
c. snaps,
d. hook and loops,
e. ribbons,
f. frog closures,
g. ribbon and eyelets,
h. elastic and respective anchors
i. zippers.

8. A travel carrier having a first half and a second half, said first half and said second halves defining a hollow interior and are attached one to the other on at least one side with a hinge such that there is a pivot about said hinge for substantially three-hundred-sixty degrees, said first half in a pivoted reversed position securable to second half via said a latching feature;

a pillow removably secured in a portion of said hollow interior by a disengaging mechanical fastener defined by said first half; a resilient member secured in a portion of said hollow interior defined by said second half; and a pair of back-pack straps affixed to an exterior of said travel carrier to facilitate convenient carrying of said travel carrier.

9. A portable compact pillow system as recited in claim 8 wherein said resilient member defines a central recess and further including a blanket removably secured within said recess.

10. A portable compact pillow system as recited in claim 9, said pillow system further comprising a pocket retainer at least partially covering said central recess, further securing said blanket therein.

11. A portable compact pillow system as recited in claim 8 wherein said latching feature is a zipper.

12. A portable compact pillow system as recited in claim 8 wherein said latching feature is a hook and loop fastener.

13. A portable compact pillow system as recited in claim 8 wherein said pillow is secured within said first half via a disengaging mechanical fastener.

14. A portable compact pillow system as recited in claim 13 wherein said disengaging mechanical fastener is selected from a group consisting of:

a. a hook and loop tape fastener,
b. buttons and respective buttonholes,
c. snaps,
d. hook and loops,
e. ribbons,
f. frog closures,
g. ribbon and eyelets, and
h. elastic and respective anchors.

15. A travel carrier having a first half and a second half, said first half and said second halves defining a hollow interior and are attached one to the other on at least one side with a hinge such that there is a pivot about said hinge for substantially three-hundred-sixty degrees, said first half in a pivoted reversed position securable to second half via said a latching feature;

a pillow removably secured in a portion of said hollow interior by a disengaging mechanical fastener defined by said first half; and a resilient member forming a recess for receiving a blanket, said resilient member being secured in a portion of said hollow interior defined by said second half; and a pocket retainer provided at least partially covering an exposed portion of said recess formed by said resilient member;

wherein said first half and said second half are attached one to the other on at least one side with a hinge such that said first half is separable from said second half and is pivotal about said hinge for substantially three-hundred-sixty degrees, said first half in its pivoted reversed position securable to said second half via said latching feature.

16. A portable compact pillow system as recited in claim 1 wherein said latching feature is a zipper.

17. A portable compact pillow system as recited in claim 1 wherein said latching feature is a hook and loop fastener.

18. A portable compact pillow system as recited in claim 15 further comprising a pair of back-pack straps affixed to an exterior of said travel carrier to facilitate convenient carrying of pillow system.

19. A portable compact pillow system as recited in claim 1 wherein said pillow is secured within said first half via a disengaging mechanical fastener.

20. A portable compact pillow system as recited in claim 6 wherein said disengaging mechanical fastener is selected from a group consisting of:

a. a hook and loop tape fastener,
b. buttons and respective buttonholes,
c. snaps,
d. hook and loops,
e. ribbons,
f. frog closures,
g. ribbon and eyelets, and
h. elastic and respective anchors.

* * * * *